United States Patent [19]

Sartoni et al.

[11] Patent Number: 4,993,121

[45] Date of Patent: Feb. 19, 1991

[54] APPARATUS FOR PREVENTING THE ESCAPE OF FIBRE SLIVER FROM FULL CANS

[75] Inventors: Sandro Sartoni; Gian F. Bonanni, both of Bologna, Italy

[73] Assignee: Savio, SpA, Pordenone, Italy

[21] Appl. No.: 353,346

[22] Filed: May 17, 1989

[30] Foreign Application Priority Data

Mar. 24, 1989 [IT] Italy ..... 19895 A/89

[51] Int. Cl.[5] ..... B65H 54/76

[52] U.S. Cl. ..... 19/159 R; 19/159 A; 19/157

[58] Field of Search ..... 19/157, 159 R, 159 A; 206/389, 392; 53/137, 235, 266, 415, 467

[56] References Cited

U.S. PATENT DOCUMENTS

| | | | |
|---|---|---|---|
| 2,877,505 | 3/1959 | Stephens | 19/159 R |
| 3,116,517 | 1/1964 | Perry | 19/159 R |
| 3,353,224 | 11/1967 | Gossett et al. | 19/159 R |
| 3,375,556 | 4/1968 | Bryan, Jr. | 19/157 |
| 3,437,232 | 4/1969 | Goodwin, Jr. | 220/93 |

*Primary Examiner*—Werner H. Schroeder
*Assistant Examiner*—Michael A. Neas
*Attorney, Agent, or Firm*—Hedman, Gibson, Costigan & Hoare

[57] ABSTRACT

This invention relates to an apparatus positioned within an automatic change-over system for cans at the exit of a drawing frame, gill box or similar machine. The apparatus prevents the escape of fibre sliver from the full cans, those latter being fitted with a semicircular strip pivoted at two diametrically opposing points below their upper rim. The apparatus has a mechanism for positioning the semicircular strip frontally forwards in the exit direction of the cans and a manipulator provided at its end with a gripper which embraces and grips the semicircular strip to raise it and arrange it above the can for the purpose of compressing the top layer of fibre sliver towards the inside of the can. This action prevents the sliver escaping from the full cans during their transportation to storage zones or during their distribution to the production departments for subsequent processing.

4 Claims, 4 Drawing Sheets

APPARATUS FOR PREVENTING THE ESCAPE OF FIBRE SLIVER FROM FULL CANS

This invention relates to an apparatus positioned within the automatic change-over system for the full cans at the exit of the drawing frame or gill box, its purpose being to mount a semicircular strip, fitted to such cans, over the upper layer of the fibre sliver filling the can in order to keep the fibre sliver compressed towards the can interior and prevent its escape during transportation to production departments for further processing.

In current textile manufacture, to prevent the fibre sliver escaping from the full cans the drawing frame or gill box operator normally presses the top layer into the can while at the same time with the other hand he lifts the semicircular strip fitted below the can rim and positions it on the layer of sliver so that it presses this layer towards the interior of the can.

The replacement or removal of the full cans is therefore completed by the manual work of the drawing frame or gill box operating personnel. The system used for automatic can change-over does not currently result in substantial personnel reduction. Moreover the manual intervention of the operating personnel is cenrtainly not the best system from the reliability aspect in that the sliver is often ruined due to excessive non-uniform compression. This results in breakage or damage of a greater or lesser degree during the subsequent processing stages. The pressing operation, i.e. pushing down the top layer of fibre sliver into the can, requires proper training and considerable attention by the personnel, and it is very difficult to attain constant repeatability with time. Another equally important aspect is that the can change-over and the corresponding compression of the top fibre layer is affected irregularly without a preset time order for a given group of drawing frames or gill boxes. This means that the operator supervising the drawing frames or gill boxes may find himself with the need to operate simultaneously on a number of individual such frames or boxes with the result that operation has to be interrupted on some of them, or they have to remain inactive. Low labour efficiency is in fact a feature of operations carried out randomly rather than at programmed time intervals. To obviate the aforesaid drawbacks the applicant has constructed and experimented with a mechanical handling apparatus forming part of the production equipment. The apparatus not only relieves personnel of the fatiguing compression operation so leaving them free for less tiresome tasks, but also ensures that the sliver is not damaged by excessive or wrongly applied compression, so that there is no danger of inconvenience or damage to the fibre sliver concerned.

Thus, the invention is in the form of an apparatus positioned within the automatic change-over system for the full cans at the drawing frame or gill box exit, said cans being fitted with a semicircular strip pivoted below their upper rim, said apparatus comprising means for positioning the semicircular strip frontally forwards in the exit direction of the cans, these means consisting of a gear system which angularly moves the can by the action of a drive source activated by an optical sensor which reads the position of refracting elements fixed to the side of the can in proximity to the pivots about which the strip rotates when said strip is raised by a manipulator means.

This latter is in the form of a manipulator arm provided at its end with gripper means, and is composed of a number of elements hinged together, said hinged elements being subjected to the action of a draw cable which keeps the manipulator arm gripper means in contact with the vertical surface of the can as they are moved downwards in order to embrace the semicircular strip. The draw cable also operates the gripper means, which on closing forcibly grip the semicircular strip of the can.

A preferred embodiment of the invention is described hereinafter by way of non-limiting example with reference to the accompanying drawings in which.

In the figures, corresponding parts are given identical reference numerals for simplicity.

Figure 1:
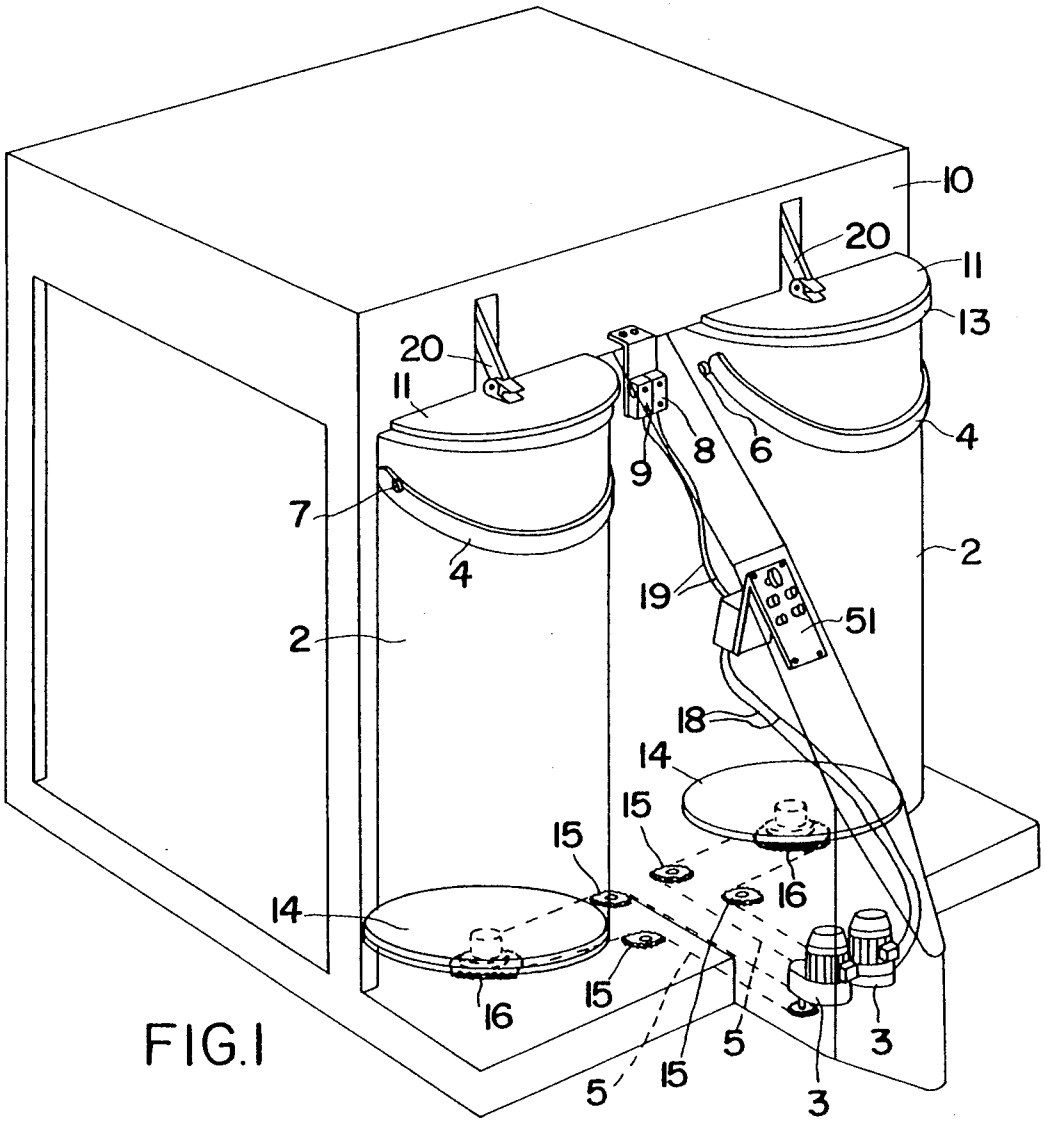
FIG. 1 is an isometric overall view of the apparatus according to the present invention in an embodiment for a two-can gill box exit, the view representing the moment in which the semicircular strips of the two cans have already been positioned frontally forwards with the two manipulator arms waiting to be moved in order to grip the semicircular strips.

Those devices and mechanisms which operate in mutual cooperation with the apparatus according to the invention are not illustrated, neither is their operation described, as they are already known and are not concerned with the operation of the present invention. For example, the coiler for depositing the fibre sliver in cycloid rings in the can standing on a rotating plate is not described or illustrated, neither is any part of the system for automatically exchanging the full cans with empty cans.

Although two exit cans are shown schematically, the apparatus described herein is suitable for use with any number of exit cans and with any type of known drawing frame, gill box or similar machine exit.

On the accompanying drawing: 1 is the fibre sliver emerging beyond the upper edge of the full can; 2 is the can in which the fibre sliver produced and drafted by the gill box is deposited; 3 are the geared motor means which effect the angular movement of the can by means of an articulated chain element 55 which, guided about idle gears 15, passes about the sprocket 16, this latter being rigid with the rotatable plate 14 which supports the can 2; 4 is the semicircular strip of vulcanized fibre or other like flexible material, fitted below the rim 13 of the can 2 in such a manner as to be able to rotate the two diametrically opposing pivots 12 so as to be lifted to lie above the can 2 in order to retain the fibre sliver 1 by compressing it into the interior of the can; 6 and 7 are the refracting elements fixed to the side of the cans 2 in proximity to the pivots 12 and which interact with the optical sensors 8 and 9 disposed in a fixed lateral position; 8 and 9 are optical sensors which at the commencement of the angular movement of the cans 2 produce signals which pass through the cables 19, the block 51 and the cables 18 to operate the motor means 3 until the moment in which said sensors 8 and 9 frontally sense the refracting elements 6 and 7. The optical interception of these latter takes place when the semicircular strips 4 have reached a forward frontal position; 10 is the casing in which the manipulator arms are located together with their operating mechanism, and under which there traverse the cans 2 filled with fibre sliver deposited by the rotating plate (not shown), this latter lying to the side of and preceding the apparatus according to the invention; 11 is a flat support plate for the manipulator arms and their operating mechanisms. Said plate projects frontally forwards from the casing 10 in the form of two semicircular surfaces under which the full cans 2 are urged so that they remain there for a time sufficient for the apparatus according to the present invention to operate; 20 is a bar acting as a forearm of the manipulator arm.

Said bar 20 is hinged by a pin 53 to the bar 27, which acts as an arm of the manipulator. Positioned about the pin 53 there is an elastic element 23 in the form of a fork which urges the forearm 20 downwards to keep the gripper means 24 in contact with the flat plate 11; 24 and 22 are the gripper means or pincer elements at rest in the open state under the action of the fork-shaped elastic element 21 positioned about the pin 55.

This latter is the hinge pin for the gripper means 22 and 24 and is also the hinge pin between said gripper means and the forearm 20; 19 is any trolley for transporting cans towards the storage zones or to the production departments for subsequent processing; 25 is a draw cable fixed to the gripper means 22 and tensioned by the pulling action of the block 26, to which it is fixed or hinged at the point 29.

Said block 26 forms the end of the rod 64 of the actuator 28. Said pulling action is generated by the constant thrust action of a helical spring 30, which urges the piston 31 of the pneumatic actuator 28 rearwards; 33 is an idle guide pulley for the draw cable 25; 34 is a flat element which at its top is connected to the rod 46 of the pneumatic actuator 42 by the hinge pin 35, and at its bottom is fixed rigidly to the transverse element or shaft 36; 32, 43 and 41 are the compressed air feed pipes to the pneumatic actuators 28 and 42; 45 is a vertical support element which at its top is connected to the actuator 42 by the hinge pin 44 and at its bottom is rigidly fixed to the flat plate 11; 40 is a pin or shaft for correctly guiding the block 37 in its horizontal movement. The transverse shaft 36 fixed rigidly to the arm 27 turns in this block; 39 is the support for the guide shaft 40. Said support 39 is fixed rigidly to the underlying plate 11; 38 is a helical thrust spring which acts constantly on the block 37. Said block 37 when in its waiting position is at rest by virtue of the fact that the opposing thrust of the actuator 42 acts on it via the rod 46 and the flat element 34; 47 is a pawl or blocking lever which prevents the full can 2 from emerging before the transporting trolley 19 is frontally present; 56 is a shaped lever which embraces the full can in order to allow it to be moved forwards by the thrust of the lateral pusher 54, already known in technical applications involving the automatic expulsion of full cans.

Said lateral pusher 54 is guided in its movement by the guide rod 52 and is driven by the action of the rod 50 of the actuator 48. The operation of the apparatus according to the present invention shown on the figures of the accompanying drawings is apparent. The lateral pushers 54, one on each side, are activated in known manner to cause the full cans originating from the gill box exit to transverse until they are positioned on the rotatable plates 14 (see FIG. 1). When the full cans 2 have been positioned on the two rotatable support plates 14 the operating stage involving the forward frontal positioning of the semicircular strips 4 begins. Said semicircular strips 4 can be in any angular position. The optical sensors 8 and 9 are activated and if neither of them senses the frontal presence of a refracting element 6 or 7 they emit electrical signals which are fed through the cables 19 to the block 51. On receiving such electrical signals, said block activates the geared motor means 3 which angularly drive the sprockets 16 via the articulated chain elements 5. As said sprockets are rigid with the plates 14 supporting the full cans, they cause said cans 2 to rotate angularly.

When a sensor frontally senses the presence of the refracting element fixed to the side of the can 2 it interrupts the electrical signal activating the corresponding geared motor 3. This latter is therefore deactivated to halt rotation of the corresponding full can 2, which is positioned with its semicircular strip 4 in a forward frontal position, and thus in the correct position for the subsequent gripping by the manipulator arm.

This is repeated equally for the other sensor when it senses the frontal presence of the refracting element fixed to the side of the other can 2. This latter is also positioned correctly with its semicircular strip 4 in a forward frontal position. The operation involving the forward frontal positioning of the semicircular strip 4 of any can 2 will be more apparent from the following description.

Figure 2:
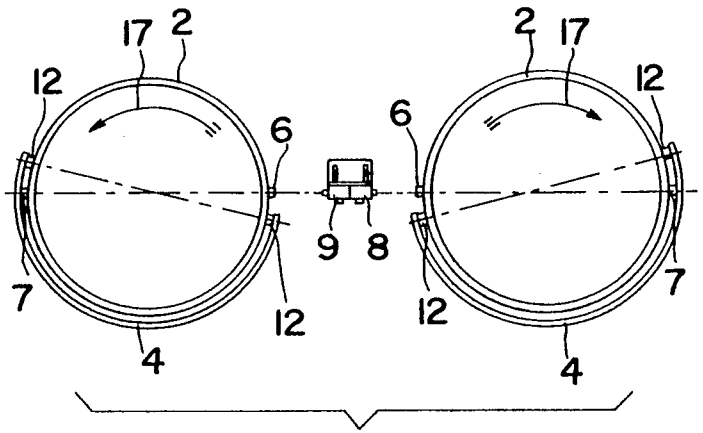
FIG. 2 is a diagrammatic plan view of the cans, the optical sensors and the refracting elements, said view representing the moment in which the angular positioning movement of the cans has brought their semicircular strips in proximity to their correct forward frontal position.
Figure 3:
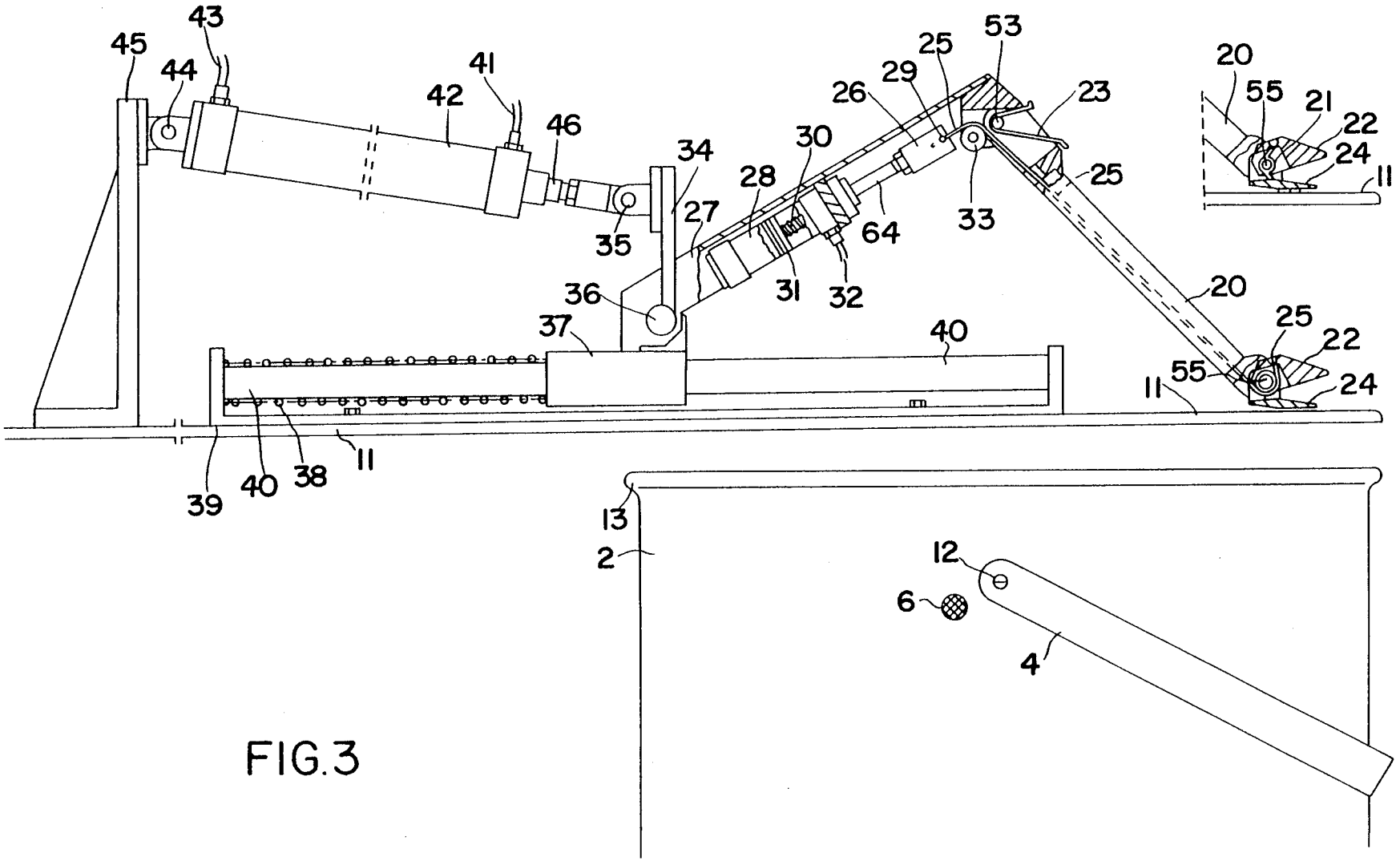
FIG. 3 is a partly sectional side view of the manipulator arm together with its operating mechanism.

The two refracting elements 6 and 7 fixed onto the side of each can 2 in proximity to the pivots 12 are positioned diametrically to each other (see FIG. 2).

The refracting elements 6 and 7 precede the pivots 12 with reference to the direction of rotation 17, and therefore their diametrical line is angularly displaced forwards from the diametrical line of the pivots 12, again with reference to the direction of rotation 17.

The semicircular strip 4 can assume two opposing positions; in one position it covers the refracting element 7 (position corresponding to FIG. 2), whereas in the other diametrically opposed position it covers the refracting element 6. The refracting element not covered by the semicircular strip 4 remains in operational relationship with the corresponding optical sensor, i.e. this latter is able to sense it.

When the optical sensor senses the refracting element in a position directly in front of it, the rotatable plate 14 rotates through an angle equal to the angle between the diametrical line joining the pivots 12 and the diametrical line joining the refracting elements 6 and 7 (see FIG. 2)

and then stops. This brings the diametrical line joining the pivots 12 in line with the optical sensors 8 and 9. This described displacement of the refracting elements 6 and 7 on each can 2 is such as to ensure with maximum certainty that the semicircular strip 4 is in a forward frontal position before operating the manipulator arm. This latter begins to move immediately after said positioning of the semicircular strip 4. The actuator 42 is activated so that its rod 46 extends. The thrust of the helical spring 38 is no longer compensated by the pull of the extending rod 46. The block 37 moves forwards sliding on the guide shaft 40 and drags with it the entire manipulator arm.

Figure 5:
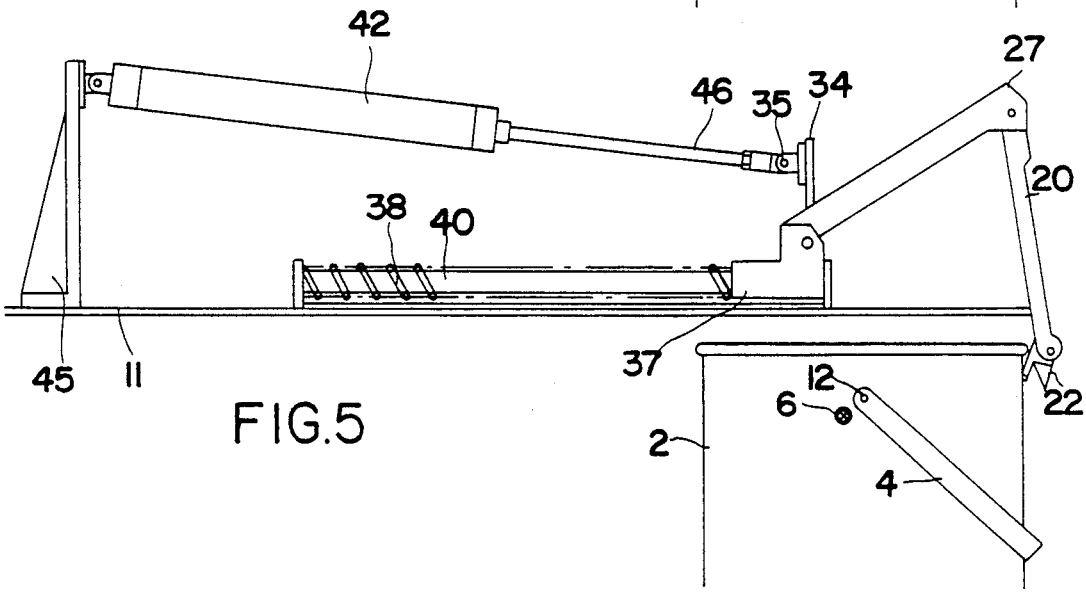
FIG. 5 is a diagrammatic side view of the manipulator arm, which has already commenced its movement for the purpose of embracing the underlying strip, said view representing the moment in which the gripper means at the end of the manipulator arm have made contact with the vertical surface of the can just below its upper rim.
Figure 6:
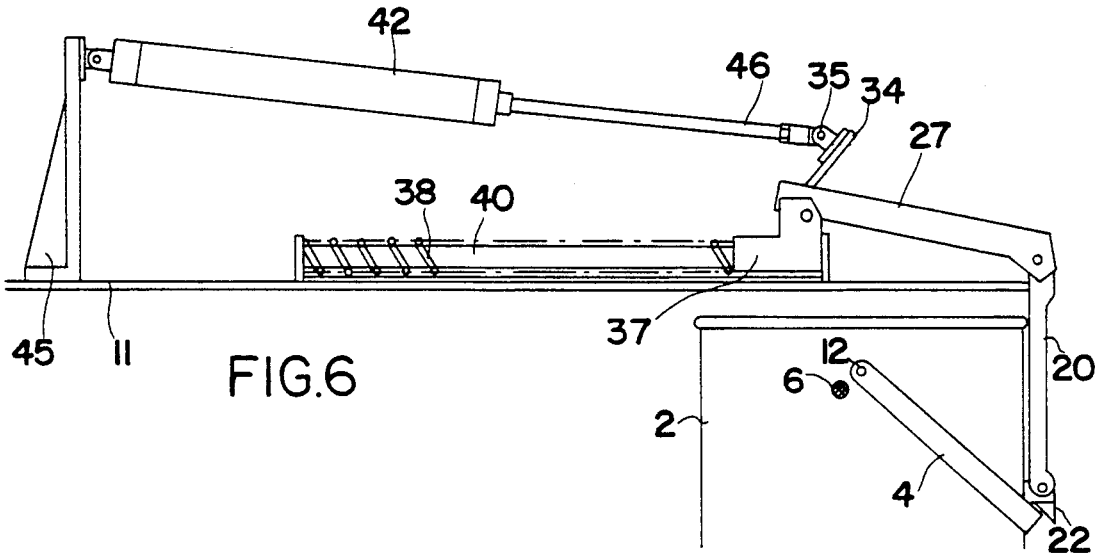
FIG. 6 is a diagrammatic side view at the moment in which the gripper means of the manipulator arm have embraced the semicircular strip of the can.

When they no longer rest on the flat plate 11, the gripper means 24 and 22 and the formarm 20 rest vertically against the rim 13 of the can 2 and then against the vertical side of the can 2. In this, the gripper means 24 and 22 rotate about the pin 55 to rest against the rim 13 by the pulling action of the draw cable 25, while the forearm 20 rests firstly against the rim 13 and is then the elastic element 23. urged to adhere to the vertical wall of the can 2 by the action of At the end of its movement the block 37 rests against the support 39, the helical thrust spring 38 being extended and the flat element 34 being still in a substantially vertical position (see FIG. 5). Under the action of the actuator 42 the rod 46 continues to extend to thus cause the flat element 34 to rotate angularly forward with consequent forward rotation of the arm 27, while the gripper means 24 and 22 in contact with the vertical wall of the can 2 are urged downwards until they embrace the semicircular strip 4. The interference between the gripper means 22 and 24 and the semicircular strip 4 prevents further descent of the forearm 20 of the manipulator arm (see FIG. 6). The rod 46 cannot extend further as further angular rotation of the flat element 34 and of the arm 37 is prevented by said interference. After the elements 22 and 24 have embraced the semicircular strip 4, the actuator 28 is activated so that by pushing the piston 31 rearwards, in addition to the continuous thrust of the spring 30, the pulling force of the draw cable 25 increases to cause the element 22 to close onto the element 24, so forcibly gripping the semicircular strip 4 of the can 2.

Figure 4:
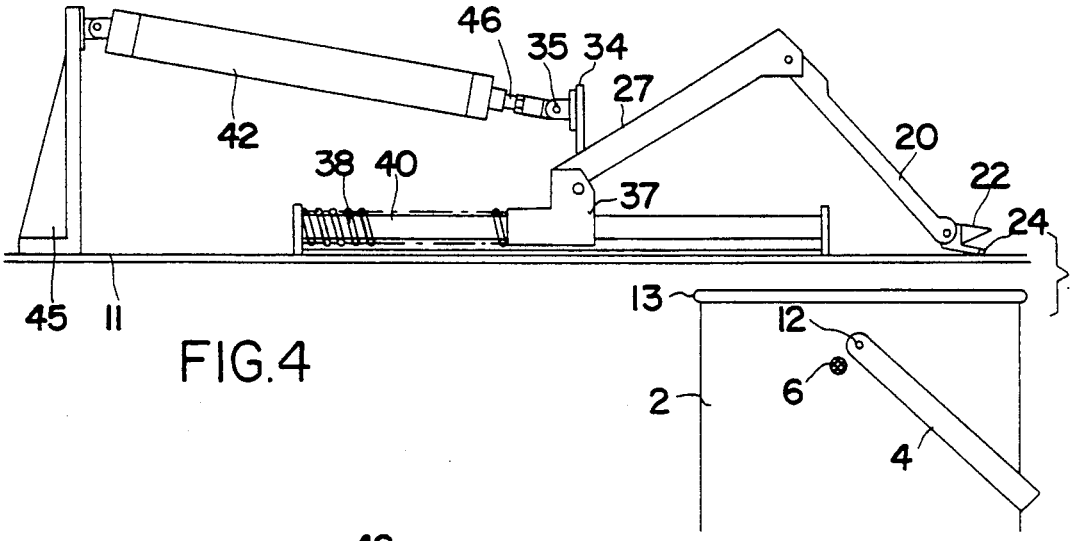
FIG. 4 is a diagrammatic side view at the moment in which the manipulator arm is waiting to be moved.

When the gripper means 22 and 24 have gripped the strip 4 the return stroke of the rod 46 is effected to initially return the flat element 34 into a vertical position (passage from the position of FIG. 5 to that of FIG. 6) and then horizontally move the block 37 until the gripper means 24 and 22 again rest and slide on the surface of the plate 11 (see FIG. 4).

Figure 7:
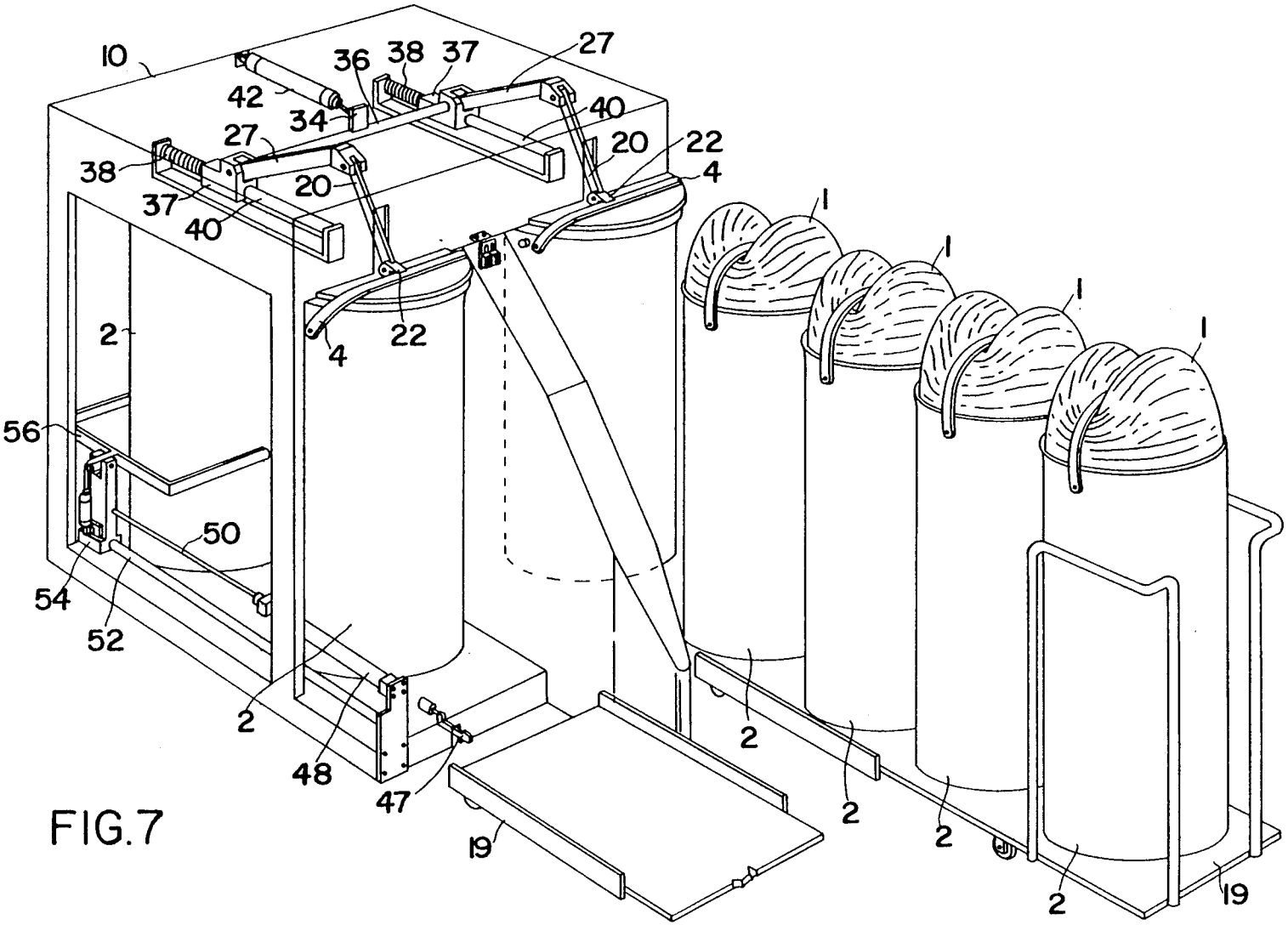
FIG. 7 is an isometric overall view of the apparatus in an embodiment for a two-can gill box exit, the view representing the moment in which the semicircular strips of the two cans have been raised and arranged above the cans by the manipulator arms; these cans are shifted and expelled forwards by a lateral pusher which is shown diagrammatically.

During this return stage the semicircular strip 4, properly retained by the gripper means 22 and 24, is raised and arranged above the surface of the plate 11 (see FIG. 7). The gripper means continue to retain said semicircular strip 4 while the lateral pusher 54 is activated to move the can 2 forward. When the semicircular strip 4 is in a substantially vertical position above the can, the actuator 28 is deactivated with the result that the pulling force of the draw cable 25 decreases to allow the gripper means 22 and 24 to open, so releasing the strip 4.

As this latter lies vertically above the can 2, which continues to be pushed outwards, it will retain the top layer of fibre sliver within the can 2 when this latter has emerged from the flat plate 11. This therefore prevents the more or less voluminous fibre sliver 1 from escaping from the full can 2.

In addition, said strip 4 keeps the fibre layers compressed in the position which they had assumed by the action of the rotating plate at the gill box exit, without danger of inconvenience or damage to the sliver.

The described operating cycle then restarts for the next two full cans which have been transferred under the apparatus of the present invention by the lateral pushers 54.

It should be noted that the various stated operating stages can at least partly overlap in time to optimize the duration of the entire operating cycle. The operating programme can be implemented by known devices of electromechanical or electronic type. The described embodiment has been presented as a non-limiting example of the invention only.

It is apparent that modifications and additions can be made to the details of the apparatus by experts of the art, but without leaving the general idea of the present invention.

We claim:

1. A device in an automatic change-over system for cans containing fibers wherein said device fits a semicircular strip on said cans for keeping said fibers in said cans, and wherein said semicircular strip pivots at two opposing points below an upper rim of the cans, comprising:

(a) means for positioning the semicircular strip in the exit direction of the cans; and (b) a manipulator for grasping and positioning the semicircular strip above the can for preventing the fibers from escaping from the can.

2. The device of claim 1 wherein said positioning means further comprises:

(a) refracting elements fixed to the side of the can in proximity to the pivots;

(b) a sensor for detecting the position of said refracting elements; and (c) a gear system including a drive source activated by said sensor for angularly moving the can.

3. The device of claim 1 wherein said manipulator further comprises:

(a) an arm including hinged elements wherein said arm has a gripper means at its end for grasping the semicircular strip; and (b) a draw cable attached to said hinged elements for keeping said gripper means of said arm in contact with a vertical surface of the can as said gripper means grasps said semicircular strip.

4. The device of claim 3 said draw cable operates said gripper means for grasping said semicircular strip.

* * * * *